United States Patent [19]

Hyltoft

[11] Patent Number: 4,699,503

[45] Date of Patent: Oct. 13, 1987

[54] ELECTROPHOTOGRAPHIC INFORMATION PRINTER WITH AUTOMATICAL DUPLEX SHEET PRINTING

[76] Inventor: Hans C. Hyltoft, No. 52, Åkandevej, DK-3500 Væ rlose, Denmark

[21] Appl. No.: 882,925

[22] PCT Filed: Oct. 21, 1985

[86] PCT No.: PCT/DK85/00096

§ 371 Date: Jun. 24, 1986

§ 102(e) Date: Jun. 24, 1986

[87] PCT Pub. No.: WO86/02746

PCT Pub. Date: May 9, 1986

[30] Foreign Application Priority Data

Oct. 25, 1984 [DK] Denmark ..... 5097/84

[51] Int. Cl.[4] ..... G03G 21/00

[52] U.S. Cl. ..... 355/14 SH; 355/3 SH; 355/24; 271/186; 271/303

[58] Field of Search ..... 355/3 SH, 14 SH, 24; 271/184, 185, 186, 288, 289, 290, 303

[56] References Cited

U.S. PATENT DOCUMENTS

| | | | |
|---|---|---|---|
| 4,305,655 | 12/1981 | Gamblin | 355/24 |
| 4,385,825 | 5/1983 | Kaneko | 355/3 SH |
| 4,453,841 | 6/1984 | Bobick et al. | 355/14 SH |
| 4,534,643 | 8/1985 | Watanabe | 355/3 SH |
| 4,536,078 | 8/1985 | Ziehm | 355/3 SH |
| 4,537,497 | 8/1985 | Masuda | 355/3 SH |
| 4,561,765 | 12/1985 | Masuda | 271/288 X |
| 4,569,582 | 2/1986 | Hyltoft | 355/3 SH |

FOREIGN PATENT DOCUMENTS

| | | |
|---|---|---|
| 141566 | 6/1985 | European Pat. Off. . |
| WO84/63972 | 10/1984 | PCT Int'l Appl. . |

*Primary Examiner*—R. L. Moses

*Attorney, Agent, or Firm*—Bernard, Rothwell & Brown

[57] ABSTRACT

In an electrophotographic information printer with a xerographic reproduction system automatic duplex printing of sheets is obtained without considerable reduction of the rate of operation in that a sheet (24) after having been discharged from a sheet supply (6, 7) is passed along a feeding path (9, 10) past an image transfer station (5) to a vertical reversing chamber (15) and therefrom fed back to the separate sheet magazine (6) having an inlet opening (23) for returned sheets positioned at the opposite end in relation to the sheet discharge opening (8). The reversing chamber (15) is integral with a sorting unit (14) in a common housing (13*a*), a selectively operable blocking member (19) and a reversing device (17), respectively, being disposed at the lower end of a vertical partition (40). In an electronically controlled information printer the operation is effected automatically in that character information is stored in a buffer memory having memory sections corresponding to print pages and, subsequently, after conversion into image information values said character information is stored in an image information memory from which the image information is read out to a scanning imaging device, the read-out from the buffer memory being effected by arbitrary, selective addressing of the said memory sections and from the image information memory in order either forwards or backwards.

8 Claims, 4 Drawing Figures

ELECTROPHOTOGRAPHIC INFORMATION PRINTER WITH AUTOMATICAL DUPLEX SHEET PRINTING

Figure 1:
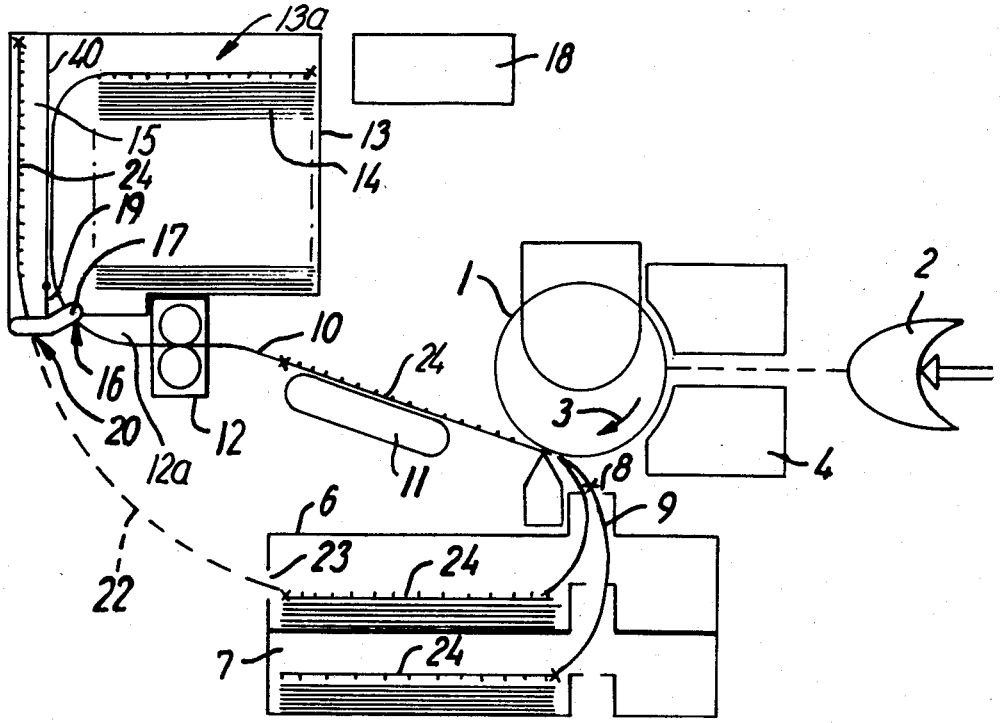

This invention relates to an electrophotographic information printer with a xerographic reproduction system, comprising a sheet supply with at least two sheet magazines each having a respective sheet discharge slit at one end of the magazine, a sheet feeding path defined by sheet feeding and sheet guide means and having a first path section from the sheet discharge slit in an arbitrary magazine to an image transfer station, in which one side of a sheet is brought into contact with a toner powder image on a moved photo conductor, a second path section from the image transfer station to a fixing device and a third path section from the fixing device to a sheet receiving device, a sheet reversing device being positioned at the third path section in connection with the sheet feeding path, said sheet reversing device comprising a substantially vertical chamber with a downwardly facing sheet entrance and sheet discharge opening and a reversing device comprising on one hand an arrangement composed of three parallel rollers with a first and a second roller nip, the inlet side of the first roller nip facing said third section of the sheet feeding path, while the second roller nip has inlet and outlet sides facing said chamber and a sheet return path, respectively, extending from the reversing device to a supply slit provided in one of said magazines opposite the sheet discharge slit and, on the other hand, a selectively operable blocking member for blocking the sheet passage between the roller arrangement and said chamber.

In this respect information printers comprise duplicating devices in the form of copying machines in which the sheet printing is effected by reproduction from an original document, as well as printers for use in connection with word or data processing systems in which the sheet printing is carried out on the basis of electronic character information transmitted from the word or data processing system.

In most of the prior copying machines duplex sheet printing can be effected only in that the sheets printed on one side are manually moved from the copy discharge chamber and then placed upside down in the sheet supply of the machine. In electronically controlled, non-xerographic information printers it is generally not possible to print on both sides of the sheet.

U.S. Pat. No. 4,385,825 discloses a copying machine for duplex sheet printing of the above mentioned type in which the reversing device at the part of the sheet feeding path located after the fixing device is adapted either to direct a sheet into the reversing chamber or to let the sheet pass through both roller nips in said arrangement of three rollers by blocking the supply opening of the reversing chamber by means of a first blocking member, and after the sheet has passed said rollers it may be directed by a second blocking member either to a copy collecting bin or to one end of a sheet conveyor from the opposite end of which the sheet by means of a further blocking member may either be returned to said one magazine or to a sheet sorting apparatus.

By the various reversing possibilities it is inter alia the purpose of said prior construction to make it possible to supply sheets to said sheet collecting bin as well as to the return magazine with a selected sheet side facing downwardly, whereby producing e.g. either sheets printed on both sides or sheets with more prints on the same side, and likewise sheets may optionally be supplied to the collecting bin with the printed sides in the same order or in reverse order in relation to the printed sides of the original document.

The reversing arrangement is however complicated due to the considerable number of selectively operable blocking members. Further, the fact that sheet reversing in the vertical chamber is necessary not only when printing on both sheet sides but also when copies shall be supplied to the collecting bins with the printed pages in the same order as the original document involves an undesired extension of the sheet passing period of this ordinarily desired function, thereby resulting in a reduction of the rate of operation.

The fact that sheets which shall not be reversed in the said three-roller arrangement always must pass two closely successive roller nips before being supplied to the collecting bin or to the said sheet conveyor increases the risk of paper jam, and this risk further increases because both the first and the second blocking members are positioned close to the rollers in said arrangement.

The object of the present invention is to provide for such an information printer the possibility of automatical duplex sheet printing, i.e. reproduction on both sides of a sheet both for information printers in the form of duplicating devices and for electronically controlled information printers by a comparatively simple structural development without the inconveniences connected with the above mentioned prior design.

To fulfil this object the information printer according to the invention is characterized in that the sheet receiving device comprises a sheet sorting arrangement having a number of substantially horizontal sheet sorting bins in connection with sheet guide means by which sheets may selectively be supplied to individual sheet sorting bins with the page printed during the sheet passage past the image transfer station facing downwardly, and that the vertical chamber of the sheet reversing device is integral in a common housing with said sheet sorting arrangement and separated therefrom by a common, substantially vertical partition at the lower edge of which said blocking member is located in the form of a flap rotatable about a horizontal axis, said flap being selectively shiftable between first and second positions, in which it blocks the sheet passage from the discharge side of the first roller nip to said vertical chamber and the sheet sorting arrangement, respectively.

In the embodiment according to the invention which, in principle, is as suited for xerographic copying machines as for electronically controlled information printers the above mentioned design of the sheet sorting arrangement and the integration thereof with the sheet reversing device in said common housing entails that besides the simple and reliable sheet reversing in duplex printing obtained per se by means of a reversing device having a vertical chamber, it is ensured by simple structural means and without making use of other shifting devices than that forming part of the sheet reversing device that the printed sheets are delivered with the printed pages in the same order as the original document both in case of simplex and duplex printing and whether a single copy or a larger number of copies of the same document is ordered.

As regards simplex printing in which no use is made of the sheet reversing device, a sheet is further supplied to the sheet sorting arrangement by passing solely through the first roller nip in the roller arrangement, thereby reducing the risk of sheet jam. As known from the above mentioned U.S. patent, the sheet is in case of duplex printing supplied to the vertical chamber of the sheet reversing device, following which the lower edge of the sheet is automatically caught in the second roller nip of the roller arrangement and then passed to the sheet returning path.

According to a preferred embodiment in which the information printer comprises a control device for carrying out various selectively operable reproduction programmes, the possibility of automatical duplex printing is obtained without serious reduction of the operation rate of the machine in that an individual drive mechanism of a sheet collecting device in connection with said one sheet magazine when adjusting the control device to effect duplex sheet printing is not actuated by the control device for sheet discharging through the discharge slit of the magazine to the first path section of the feeding path until a determined number of sheets has been returned from the reversing device to said magazine.

According to said embodiment the control device may be adapted for adjustment between a single-copy mode, in which said determined number corresponds to half the number of print pages of a document, and a multi-copy mode, in which the determined number corresponds to the number of copies to be produced of each print page.

This provides for obtaining duplex sheet printing, for instance when copying a document consisting of many print pages in an information printer designed as a xerographic copying machine which is preferably provided with an automatical original feeding device, by first copying every second print page of the original on one side of each of a corresponding number of sheets which via the sheet reversing device and the return path are collected in order of succession in the determined sheet magazine with the last copied print page at the top, then copying the remaining print pages of the original in reverse order in relation to the preceding copying on the first side of each sheet. As explained in detail in the following the print pages copied during the second run must be reversed in relation to the printed pages copied the first time in order that the print pages may appear with the same orientation on both sides of a sheet. This embodiment may appropriately be used in such a way that the user first makes copies of every second print page of the original, for instance the pages having even page numbers, starting with the highest page number, then makes copies of the remaining printed pages, i.e. the pages with uneven page numbers, starting with the lowest page number. This provides for obtaining without noticeably reducing the operation rate of the machine a very fast production of a single copy of an original.

According to another development particularly intended for electronically controlled information printers to be used in connection with word or data processing systems for printing electronical character information a correspondingly highquick cycle of operating rate for duplex printing is achieved in that it comprises a buffer memory for receiving said character information from the word or data processing system, said buffer memory being divided into storage sections individually containing the information corresponding to a full print page, addressing means for addressable read-out of the character information from an arbitrary section of the buffer memory, a processor for calculating image information values on the basis of the character information thus read out, an image information memory for receiving image information values from one section of the buffer memory at a time, means for serial read-out of the image information values from the image information memory in a selectable order and a scanning imaging device controlled by the read-out image information values for transferring the image information to the moved photo conductor, said control device being adapted to read out the image information values of the memory sections in the buffer memory containing character information for uneven-numbered pages of a document in one order of succession and of memory sections containing character information for even-numbered pages in the reverse order.

According to the above mentioned embodiment the operation is completely automatic, since also the change of the order of copying and the reverse orientation of the original required by a document copying machine is effected in this case directly by the programme control in the control unit of the information printer.

Figure 2:
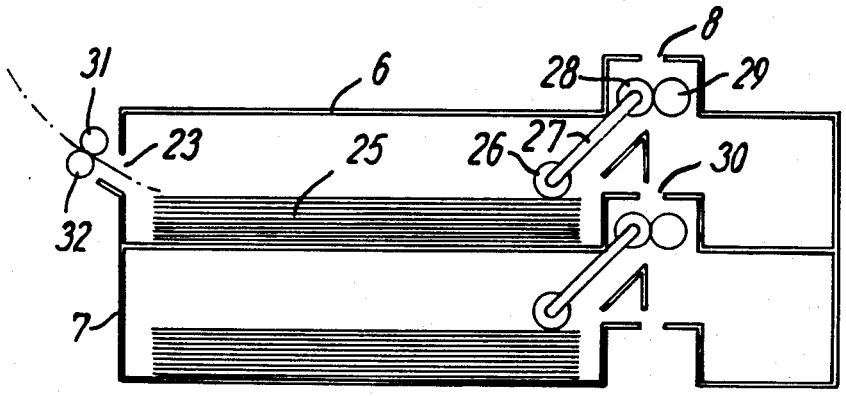
Figure 4:
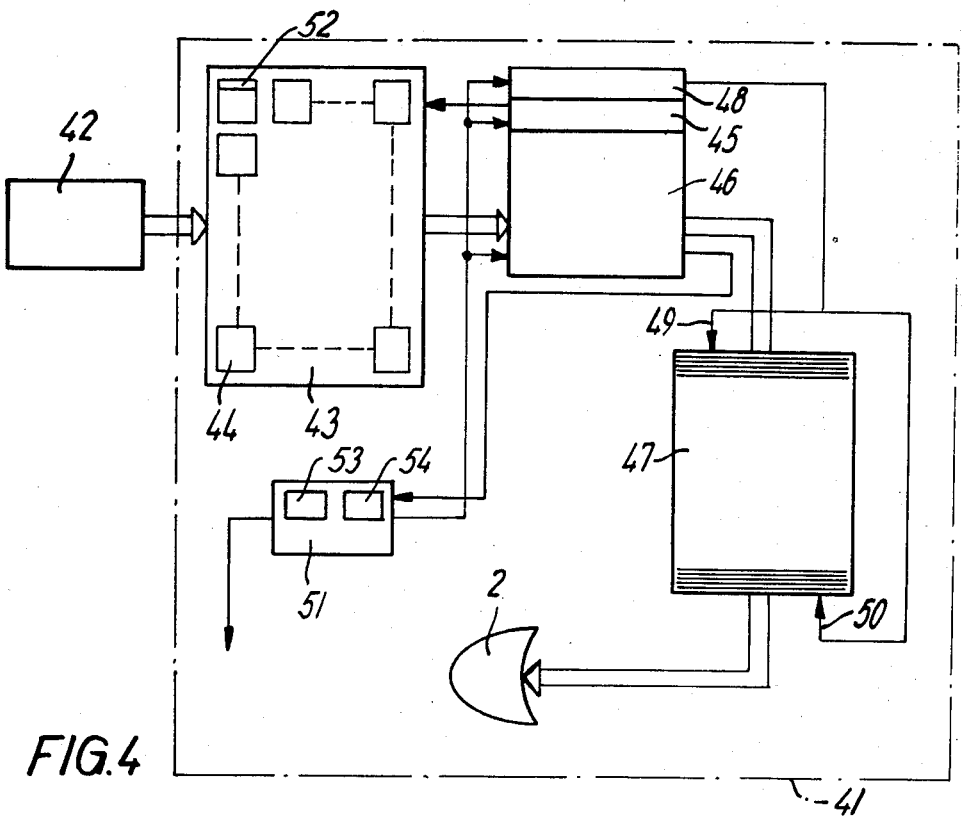
Figure 3:
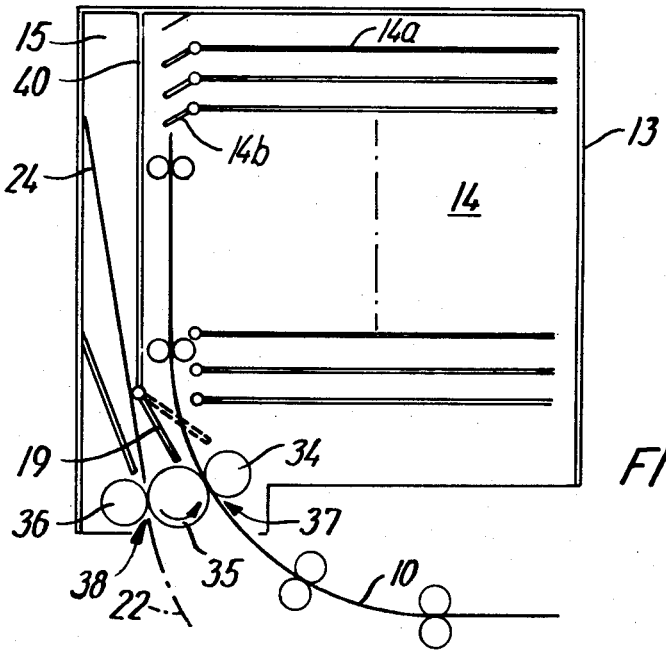

The invention will be more fully explained in the following with reference to the accompanying drawings, in which FIG. 1 is a schematical view of the parts necessary to understand the invention of an embodiment of an information printer, FIGS. 2 and 3 show embodiments of a sheet supply with separate sheet magazines and a sheet receiving device, respectively, of an information printer as illustrated in FIG. 1, and FIG. 4 is a block diagram of character information processing units of an electronically controlled information printer for word and data processing systems.

The xerographic reproduction system of an information printer according to the invention shown purely schematically in FIG. 1 is of the same type as disclosed in international patent application No. PCT/DK84/00022, publication No. WO84/03972, and comprises as a photo conductor a rotating drum 1 on which after electrostatic charging a latent electrostatic image may be formed in a known manner by means of an imaging device 2.

The imaging device 2 may either be an optical system, e.g. line scanning, in a photo copying machine or may consist in an electronically controlled information printer for word or data processing systems, e.g. of a cathode-ray tube.

The latent electrostatic image on the drum rotating in the direction illustrated by the arrow 3 is developed by toner powder supplied from a developing device 4.

In an image transfer station the toner powder image is transferred to the side facing the drum 1 of a sheet in contact with a sheet of a printing material, preferably paper, in contact with the drum.

In the information printer illustrated in FIG. 1 a sheet supply 1 includes two separate sheet magazines 6 and 7, the detailed structure of which appears from Fig. 2. From each of the magazines 6 and 7 sheets may be collected individually from a pile of sheets accommodated in the magazine and may be passed through a sheet discharge slit 8 along a first path section 9 in a sheet feeding path drawn in solid lines to the image transfer station 5.

In the illustrated embodiment an angular turn of 150° is applied to the sheet on the path section 9 so that a toner powder image on the drum 1 is transferred to the side of the sheet facing downwardly in the starting position in the pile of sheets in the magazine.

From the image transfer station 5 the sheet is supplied by means of a belt conveyor 11 along a second path section 10 in the sheet feeding path to a fixing device 12.

Having passed the fixing device 12 the sheet is passed along a third path section 12*a* to a sheet receiving device 13. In the illustrated embodiment the sheet receiving device 13 comprises a sorting unit 14 of a design known per se for receiving printed sheets in a number of sheet bins 14*a*, on one hand, and a vertical sheet reversing chamber 15, on the other hand.

The sorting unit 14 and the reversing chamber 15 are integral in a common housing 13*a* which in a manner not specified may constitute a separate module adapted to be arranged externally with respect to the information printer.

A reversing device 17 is located at a sheet supply opening 16 of the housing 13*a* and comprises a blocking member 19 selectively operable from a control unit 18 and shiftable between positions in which a sheet is supplied to the sorting unit 14 and to the reversing chamber 15, respectively.

A preferred embodiment of the reversing device 17 is explained in the following with reference to FIG. 3.

At the downwardly facing sheet supply and discharge opening 20 of the reversing chamber 15 the reversing device 17 will catch any sheet fed into the reversing chamber 15 and pass it to a sheet returning path 22, shown in dotted lines, which extends from the reversing device 17 to one of the sheet magazines, in this case the upper sheet magazine 6, into which a sheet moved along the sheet feeding path 22 is supplied through a sheet supply slit 23 opposite the sheet discharge slit 8.

The sheet returning path 22 has such a course that a sheet fed back from the reversing chamber 15 will be supplied to the magazine 6 with the side which after the printing operation in the image transfer station 5 and the subsequent fixing has a printed picture facing upwards, i.e. reversed in relation to the starting position of the sheet in the pile of sheets from which it was discharged.

In the illustrated embodiment with two sheet magazines the sheet magazine 6 is solely utilized as a determined magazine for collecting returned sheets, the control unit 18 controlling all processing operations in the printer actuating the sheet collecting device associated with the magazine 6 only after at least one returned sheet has been fed into the magazine.

To further illustrate the operation of the printer when printing a sheet on both sides a single sheet 24 is illustrated in various positions in the magazine, the edge of said sheet lying foremost in the supply path 9, 10, 12*a* being designated with the symbol x, whereas the side printed in the first passage past the image transfer station 5 is marked with a number of short, projecting line symbols.

As it appears from the preceding the sheet is discharged from the magazine 7 and as illustrated in FIG. 1 the sheet will after being fed back be supplied to the magazine 6 with its printed page facing upwards and the edge designated x facing to the rear, so that the opposite end when feeding the sheet to be printed on the other side will lie upstream in the feeding path.

The design of the information printer with at least two separate sheet magazines of which one is solely used as a collecting magazine for returned sheets implies that the printing of sheets on both sides may be effected automatically without considerably reducing the rate of operation of the printer, which may for instance be 20 sheets a minute, both as regards production of a single copy of a many-paged document and as regards multi-copying.

In an information printer in the form of a copying machine for reproduction of original documents this mode of operation is realized in that in a first operational sequence printing of the necessary number of sheets is effected, i.e. corresponding to half the number of printed pages of the original document, and all the sheets are returned to the collecting magazine 6, following which printing is effected in another operation of the same sheets on the reverse side. Thus, the transport time for returning a sheet from the reversing chamber 15 to the magazine 6 will only entail a minor increase of the total reproduction time.

It will appear, however, that the sheets in the pile of sheets collected in the magazine will be in reverse order the last printed sheet lying at the top. Therefore, for a copying machine it may be advantageous for duplex printing to prescribe that in a first operational sequence even-numbered pages, i.e. left pages in the finished printed copy, is reproduced starting with the highest page number, and then in a second operational sequence the remaining uneven-numbered pages, i.e. right-hand pages are reproduced, starting with the lowest page number.

By making use of this operational instruction the major advantage is achieved when producing a single copy that it is possible to make use of an automatic document feeding device of the kind well known from copying machines so as to maintain a high rate of operation.

In multicopying with preparation of a number of reproduction copies of the original document it is, on the contrary, most convenient to finish printing of both sides of a reproduction sheet at a time.

For automatic performance of said operational programmes the control unit 18 of the printer may in this design be adapted for selective switching between a single-copy mode and a multi-copy mode and may be connected with a keyboard for entering the number of print pages of the original document in the single-copy mode and the number of desired reproduction copies in the multi-copy mode so that the operator only has to take care of the correct orientation of the print pages of the original document.

FIG. 2 illustrates the detailed embodiment of the sheet supply comprising the two separate sheet magazines 6 and 7. The selectively operable sheet collecting device in each magazine comprises a friction roller 26 positioned against the upper sheet of a pile of sheets 25 placed in the magazine, said friction roller being operatively connected through a toothed belt 27 with the driven roller 28 of a pair of feeding rollers 28, 29 situated immediately beneath the sheet discharge slit 8 of the magazine in connection with the first path section 9 of the sheet feeding path.

The sheet magazines 6 and 7 may form part of an arrangement having a number of sheet magazines optionally selectable by means of the associated sheet collecting devices, each of said magazines comprising at the bottom a sheet supply slit 30 in connection with the sheet discharge slit in the underlying magazine so that sheets discharged from one of the lower magazines are passed up through the superposed magazines by means of the pairs of feeding rollers disposed therein.

The selective activation of the sheet collecting device in each of the sheet magazines is obtained by using in each magazine an individual drive means in the form of an electronic stepping motor as explained in detail in published European patent specification No. 0141566.

As explained above the operation is controlled in the information printer according to the invention in connection with duplex sheet printing in such a way that a determined sheet magazine, preferably the upper magazine 6, is reserved for collecting sheets returned from the reversing chamber 15 of the sheet receiving device 13. In this respect the sheet magazine 6 is at the opposite end relative to the sheet discharge slit 8 provided with the sheet supply opening 23 in connection with a pair of supply rollers 31, 32.

FIG. 3 illustrates in more detail the embodiment of the sheet receiving device 13 in FIG. 1 comprising a sorting unit 14 having a number of bins 14*a* for sorting the supplied sheets in individual sets of copies by multicopying and sheet guide means 14*b* supplying sheets individually to the respective bins 14*a* with the last printed sheet side facing downwards.

The substantially vertical reversing chamber 15 is provided at its bottom with a slit-shaped sheet entrance and discharge opening 20 extending in parallel and lateral relation to the sheet entrance 16 to the sorting unit 14.

The reversing device 17 purely schematically illustrated in FIG. 1 for guiding sheets into the receiving device 13 and catching a sheet supplied to the reversing chamber 15 is constituted by an arrangement of three rollers 34, 35 and 36 having a first and a second roller nip 37 and 38 disposed opposite the sorting unit 14 and the reversing chamber 15, respectively. Said three rollers 34, 35 and 36 are driven by a drive means not shown for rotation with the directions of revolution shown by arrows.

By means of the selectively operable blocking member 19 which is pivotal about an axis at the lower end of a substantial vertical partition 40 between the sorting unit 14 and the reversing chamber 15 a sheet which from the third path section 12*a* of the sheet feeding path is guided through the roller nip 37 between the rollers 34 and 35 may optionally be directed either to the sorting unit 14 in the solid-line position of the guide plate 19 or to the reversing chamber 15 in the dashed position of the guide plate.

After the sheet 24 has been fed into the the reversing chamber 15 it occupies as shown a substantially vertical position and as soon as the sheet has been completely passed into the reversing chamber 15, its lower edge, e.g. the rearmost edge in the sheet feeding path, will automatically be caught by the roller nip 38 between the rotating rollers 35 and 36, thereby guiding the sheet into the returning path 22 and returning it to the sheet magazine 6 through the sheet supply slit 23 thereof, said magazine 6 being beforehand determined as a collecting magazine.

A very safe and quick automatic sheet returning in duplex sheet printing is obtained by the above, comparatively simple, structural design of the sheet receiving device 13.

With reference to the block diagram in FIG. 4 it will be explained in the following how automatic, duplex sheet printing without assistance from the operator can be realized by an electronically controlled information printer according to the invention for use in connection with word or data processing systems. The character information processing parts of the information printer necessary for the proper understanding of the subject are shown within a dotted frame 41 while 42 indicates a word or data processing system from which electronic character information are transferred to the information printer. The supplied character information is received in the buffer memory 43 divided into memory sections 44 individually containing the character information corresponding to a complete print page. From a programmed address register 45 the individual memory sections 44 of the buffer memory 43 may be addressed individually in an arbitrary order with a view to reading out the character information content of the addressed memory section to a processor unit 46 which on the basis of the supplied character information calculates image information values and stores them in an image information memory 47 from which the image information values are subsequently read out to the imaging device 2 consisting in this case of a cathode ray tube. The image information memory 47 has a storage capacity suitable for a desired image resolution for the imaging device 3, for instance for receiving $8\times10^6$ image information values occuring as single bits.

By means of a separate address register 48 the image information values in the memory 47 may be read out in order either forwards or backwards as schematically shown by arrows 49 and 50 at the upper and lower end, respectively, of the block showing the memory 47.

In automatic operational control in duplex sheet printing the information printer is provided with a control device 51 formed as a programme control device by which the read-out of the image information values from the memory 47 is effected in such a manner that the read-out takes place in one order for an information content in the memory 47 transferred from memory sections in the buffer memory 43 with character information for uneven-numbered pages of the document to be copied, and in the reverse order for an information content in the memory 47 transferred from memory sections in the buffer memory 43 with character information for even-numbered pages.

In the same manner as explained above concerning reproduction from original documents automatic duplex sheet printing by the electronically controlled information printer illustrated in FIG. 4 can be obtained in that the control device 51 is adapted to be selectively switched between a single-copy mode in which all memory sections corresponding to even-numbered pages, i.e. the left pages of the desired document, are read out from the buffer memory 43 in a first operational sequence in order from the highest to the lowest page number, following which, after printing of a corresponding number of sheets with the image information concerned from the buffer memory 43, the remaining memory sections corresponding to uneven-numbered pages are read out, i.e. the right-hand pages of the desired document, in order from the lowest to the highest page number, and a multi-copy mode in which memory sections are read out from the buffer memory in pairs corresponding to two successive pages, copying at first the even-numbered pages.

In view of the fact that the sheet guide means 14b of the sorting unit 14 are controlled in the multicopy mode from a sorting control circuit 53 forming part of the control device 51, it is further possible in an electronically controlled information printer of which the character information processing parts are structured as shown in FIG. 4 to vary in the multi-copy mode the number of printed pages of the sets of copies delivered in the sheet bins 14a of the sorting unit 14. It is thereby possible to produce sets of copies of which some do not include certain print pages with information not desired to be reported to the receiver of the sets of copies concerned.

For this purpose information about arbitrary individual sorting bins into which copies of arbitrary individual print pages shall not be delivered may be entered from a keyboard not shown in a part 52 of each memory section 44 in the buffer memory 43. In the readout of the character information of such a memory section by means of the processor 46 to the image information memory 47 said information is read out at the same time to the sorting control device 53 which supplies control signals for operation of the sheet guide means 14*b* in response to said information.

Since such print pages that are not desired to be included in all the sets of copies delivered to the sheet bins 14*a* of the sorting unit 14 in duplex sheet printing may occur, for instance, as even-numbered pages so that sheets containing such print pages not desired to be delivered to certain bins of sheets shall only be printed on one side, the control device further comprises a control circuit 54 for the reversing device 17 so that sheets to be delivered in certain bins 14*a* with only the first printed side are guided directly to the sorting unit 14.

This provides for obtaining an extremely flexible document processing which has in fact been made possible by the integration of the reversing chamber and the sorting unit in a common module which is characteristic of the invention.

As mentioned above, such a module may, moreover, be carried out as a separate external exchange or supplementing module to be mounted externally of the information printer, e.g. in connection with a sheet discharge slit at the top side of the housing of the information printer. Thereby, the need of reserving space in the housing of the information printer for the comparatively voluminous sorting and sheet reversing device may be dispensed with and the information printer may optionally be delivered either with a simple sorting unit without a sheet reversing device or with a combined sorting and sheet reversing unit.

I claim:

1. An electrophotographic information printer with a xerographic reproduction system, comprising a sheet supply with at least two sheet magazines (6, 7) each having a respective sheet discharge slit (8) at one end of the magazine, a sheet feeding path defined by sheet feeding and sheet guide means and having a first path section (9) from the sheet discharge slit in an arbitrary magazine to an image transfer station (5), in which one side of a sheet is brought into contact with a toner powder image on a moving photo conductor (1), a second path section (10) from the image transfer station (5) to a fixing device (12) and a third path section from the fixing device (12) to a sheet receiving device (13), a sheet reversing device being positioned at the third path section in connection with the sheet feeding path, said sheet reversing device comprising a substantially vertical chamber (15) with a downwardly facing sheet entrance and sheet discharge opening (20) and a reversing device (17) comprising on one hand an arrangment composed of three parallel rollers (34, 35, 36) with a first and a second roller nip (37, 38), the inlet side of the first roller nip (37) facing said third section of the sheet feeding path, while the second roller nip (38) has inlet and outlet sides facing said chamber (15) and a sheet return path (22), respectively, extending from the reversing device (17) to a supply slit (23) provided in one of said magazines (6) opposite the sheet discharge slit (8) and, on the other hand, a selectively operable blocking member (19) for blocking the sheet passage between the roller arrangement and said chamber, characterized in that the sheet receiving device (13) comprises a sheet sorting arrangement (14) having a number of substantially horizontal sheet sorting bins (14*a*) in connection with sheet guide means (14*b*) by which sheets may selectively be supplied to individual sheet sorting bins with the page printed during the sheet passage past the image transfer station (5) facing downwardly, and that the vertical chamber (15) of the sheet reversing device is integral in a common housing (13*a*) with said sheet sorting arrangement (14) and separated therefrom by a common, substantially vertical partition (40) at the lower edge of which said blocking member (19) is located in the form of a flap rotatable about a horizontal axis, said flap being selectively shiftable between first and second positions, in which it blocks the sheet passage from the discharge side of the first roller nip (37) to said vertical chamber (15) and the sheet sorting arrangement (14), respectively.

2. An electrophotographic information printer as claimed in claim 1, comprising a control device (18) for carrying out different, selectively operable reproduction programmes, characterized in that an individual drive mechanism for a sheet collecting device (26) in connection with said one sheet magazine (6) when adjusting the control device to effect duplex sheet printing is not actuated by the control device for sheet discharging through the discharge slit (8) of the magazine to the first path section (9) of the feeding path until a determined number of sheets has been returned from the reversing device (17) to said magazine (6).

3. An electrophotographic information printer as claimed in claim 2, characterized in that the control device (18) may be adapted for adjustment between a single-copy mode, in which said determined number corresponds to half the number of print pages of a document, and a multi-copy mode, in which the determined number corresponds to the number of copies to be produced of each print page.

4. An electrophotographic information printer as claimed in claim 1, 2 or 3, for use in connection with word or data processing systems for printing electronical character information, characterized in that it comprises a buffer memory (43) for receiving said character information from the word or data processing system (42), said buffer memory being divided into storage sections (44) individually containing the information corresponding to a full print page, addressing means (45) for addressable read-out of the character information from an arbitrary section (44) of the buffer memory (43), a processor (46) for calculating image information values on the basis of the character information thus read out, an image information memory (47) for receiving image information values from one section (44) of the buffer memory (43) at a time, means (48) for serial read-out of the image information values from the image information memory (47) in a selectable order and a scanning imaging device (2) controlled by the read-out image information values for transferring the image information to the moved photo conductor (1), said control device being adapted to read out the image information values of the memory sections (44) in the buffer memory (43) containing character information for uneven-numbered pages of a document in one order of succession and of memory sections (44) containing character information for even-numbered pages in the reverse order.

5. An electrophotographic information printer as claimed in claim 3, characterized in that the control device (51) is adapted to read out at first in said single-copy mode all memory sections (44) corresponding to even-numbered pages in order from the highest to the lowest page number and after the printing of sheets with image information corresponding thereto to read out the remaining memory sections (44) corresponding to unevenumbered pages in order from the lowest to the highest page number, and to read out in said multi-copy mode memory sections in the buffer memory (43) in pairs corresponding to two successive pages, reading out at first the even-numbered pages.

6. An electrophotographic information printer as claimed in claim 5, characterized in that the control device (5) comprise a sorting control circuit (53) operable in the multi-copy mode to actuate the sheet guide means (14*b*) of the sheet sorting arrangement to selectively supply sheets to said sorting bins (14*a*), and that the memory sections (44) of the buffer memory (43) in the multi-copy mode may receive information about individual sorting bins (14*a*) that shall not receive a copy of the print page concerned, said information being read out to said sorting control circuit when reading out the character information of the memory section concerned.

7. An electrophotographic information printer as claimed in claim 6, characterized in that the control device (51) is switchable between operating conditions with simplex and duplex sheet printing and that said information about sorting bins that shall not receive copies is further read out to a control circuit for said reversing device (17).

8. An electrophotographic information printer as claimed in claim 1 any of the preceding claims, characterized in that the common housing (13*a*) with the sheet sorting arrangement (14) and the vertical chamber (15) of the sheet reversing device constitutes a separate external exchange module to be mounted on the outside of the information printer.

* * * * *

UNITED STATES PATENT AND TRADEMARK OFFICE

CERTIFICATE OF CORRECTION

PATENT NO. : 4,699,503

DATED : October 13, 1987

INVENTOR(S) : HANS C. HYLTOFT

It is certified that error appears in the above-identified patent and that said Letters Patent is hereby corrected as shown below:

In column 11, line 22, in the third line of claim 6, after "device" delete "(5)" and substitute therefor --(51)--.

Signed and Sealed this

Seventeenth Day of May, 1988

*Attest:*

*Attesting Officer*

DONALD J. QUIGG

*Commissioner of Patents and Trademarks*